US006375496B1

(12) United States Patent
Casey et al.

(10) Patent No.: US 6,375,496 B1
(45) Date of Patent: Apr. 23, 2002

(54) DOUBLE STACK ELECTRICAL CONNECTOR WITH INTEGRAL GROUND PLANE

(75) Inventors: Daniel T. Casey; George I. Peters, Jr., both of Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/664,395

(22) Filed: Sep. 18, 2000

(51) Int. Cl.[7] ..... H01R 13/66

(52) U.S. Cl. ..... 439/541.5; 439/540.1; 439/76.1

(58) Field of Search ..... 439/540.1, 354, 439/108, 95, 541.5, 607, 701, 74, 608

(56) References Cited

U.S. PATENT DOCUMENTS

| | | | | |
|---|---|---|---|---|
| 3,829,821 A | | 8/1974 | Derr et al. | 339/91 R |
| 5,030,115 A | | 7/1991 | Regnier et al. | 439/108 |
| 5,080,609 A | | 1/1992 | Fabian et al. | 439/540 |
| 5,085,590 A | * | 2/1992 | Galloway | 439/541.5 |
| 5,267,876 A | | 12/1993 | Rupert et al. | 439/540 |
| 5,579,425 A | | 11/1996 | Lampert et al. | 385/59 |
| 5,647,043 A | | 7/1997 | Anderson et al. | 385/78 |

* cited by examiner

*Primary Examiner*—Renee Luebke
*Assistant Examiner*—Briggitte R. Hammond
(74) *Attorney, Agent, or Firm*—Woodcock Washburn LLP

(57) ABSTRACT

An electrical connector is mounted onto a primary circuit board to provide a stacked interface between plug members and the primary circuit board. The connector comprises a frame having interfaces therein which are spaced in substantially parallel and vertical juxtaposition to each other along the length of the frame. The interfaces are electrically coupled to a primary circuit board by an intermediate circuit board. Each interface includes an inner wall which isolates and provides shielding for the plugs. Additional shielding is provided by a conductive member which is mounted onto the intermediate circuit board, parallel to and between the interfaces. In order to augment the mechanical connection between the connector and the primary circuit board flexible mounting studs are provided on the bottom of the connector.

21 Claims, 7 Drawing Sheets

DOUBLE STACK ELECTRICAL CONNECTOR WITH INTEGRAL GROUND PLANE

FIELD OF THE INVENTION

This invention generally relates to stackable connector assemblies and more particularly, to a stackable connector assembly which provides an interface between plug members and a printed circuit board and has a shielded signal path.

BACKGROUND OF THE INVENTION

In order to conserve space on a printed circuit board, stackable connectors are employed. Stackable connectors provide a convenient way to interconnect two or more interface ports to a circuit board without consuming large amounts of space. In general, a stackable electrical connector comprises a metal bracket which supports the interface ports in a superposed relationship and a pin extension member for mating the contact elements of the interface ports with the conductors on the circuit board.

U.S. Pat. No. 5,080,609-Fabian discloses a stacked electrical connector assembly comprising a sheet metal supporting bracket having superposed upper and lower connector lugs for mounting an upper and lower interface port. The bottom surface of the bracket houses a pin header which mates directly with a printed circuit board. The upper interface is connected to the pin header by a flat cable which extends downwardly from the top of the upper interface. The lower interface is in contact with the circuit board via bent contact tails which extend from the rear of the lower interface through the bottom of the bracket.

Connectors of the type disclosed in Fabian must be secured onto the printed circuit board. Normally, this is accomplished when the pin contacts of the connector are mated with corresponding receiving ports on the circuit board. The mechanical link between the pins and the ports is augmented by screws placed through openings located at the bottom of the central support bracket which correspond to openings on the circuit board. Before the screws are placed through the openings on the connector and circuit board, the connector's pin contacts are mated onto the circuit board. A drawback to this system is that once the pin contacts of the connector are mated into the circuit board, inserting screws can cause lateral movement of the connector which could result in damage to the pin contacts.

Stacked connectors must also provide for shielding from electromagnetic emissions. Electromagnetic emissions induce currents that adversely affect the transmission of electric signals. In a typical stacked connector, such as the one disclosed in Fabian, a signal received through one interface can induce a current in an adjacent interface. Often, the wiring set between the upper interface and the circuit board and the wiring set between lower interface and the circuit board, are positioned in close proximity to each other. This close proximity increases the likelihood that a signal received by an interface and communicated to the printed circuit board will either interfere with, or generate a false signal in, the adjacent interface.

In order to prevent stray currents, stacked electrical connectors have been provided with shielding. For example, U.S. Pat. No. 5,085,590-Galloway, discloses an electrical connector similar to Fabian with the addition of a metallic shield member which is placed between, and parallel to, the upper and lower interfaces. The shield member is intended to block electromagnetic emissions from the two interfaces from reaching each other. However, the shield is insufficient since it does not extend along the entire length of the connector. This can allow substantial electromagnetic emissions from the interfaces to travel around the ends of the shield.

Currently, there is no stacked connector available which can be easily, but sufficiently, latched to a printed circuit board and which stacked connector also provides complete shielding from electromagnetic emissions. Thus, a need exists for such a stacked connector.

SUMMARY OF THE INVENTION

According to the present invention, a stacked electrical connector is provided which is mounted onto a primary circuit board for providing a stacked interface for multiple plug elements. The connector is easily and securely mounted to the circuit board and prevents the formation of stray currents along the signal path of the connector.

The stacked connector generally comprises a frame which defines a first and a second interface. The interfaces are spaced in substantially parallel and vertical juxtaposition to each other along the length of a frame and are electrically coupled to a primary circuit board. Each interface mates with a plug member whereby the interfaces are also electrically coupled to the primary circuit board. The interfaces are defined within and completely enclosed by the frame. The frame is constructed so that when the plug elements are placed within the interfaces, they are securely retained therein in isolation from each other. In particular, the interfaces include side walls, an inner wall and an outer wall. Each interface is located within the frame so that its inner walls face each other. The inner walls are constructed from a conductive material such that they shield the end of the plug members from electromagnetic emissions.

The plugs are maintained within the interfaces by an interference fit. In order to increase the interference fit, each plug member is provided with a latch. The outer wall of each interface includes a latching notch and a surface which engages the latch of the plug elements. The latching notch acts as a guide for the latches, and hence the plug members, as they are inserted into the interfaces. As the latches are inserted into the interfaces, they engage the inner surfaces of the outer walls increasing the interference fit between the plug and the interface.

Each interface is electrically coupled to the primary circuit board by an intermediate circuit board. The intermediate circuit board is mounted on the frame perpendicular to the interfaces. Each interface includes contacts which at one end define receptacle sections and at the opposite end define pin contacts. The pin contacts mate with contact slots on the intermediate circuit board which is directly coupled to the primary circuit board. Alternatively, the pin contacts of the interfaces are connected directly to the primary circuit board by a flat wire or multiple independent wires.

The pin contacts of each interface extend beyond the inner wall of the interfaces, into the circuit board. Thus, the inner walls do not shield the pin contacts of the interfaces from each other. In order to shield the pin contacts from each other, a shielding circuit board is mounted to the intermediate circuit board so as to extend within the frame between and parallel to the interfaces. The shielding circuit board extends along the entire width of the frame so as to abut the walls of the frame and completely isolate the pin contacts from each other.

The intermediate circuit board is electrically coupled to the primary circuit board by a right angle header. The right angle header includes pin contacts which mate with contact slots on the primary circuit board. The mechanical link between the contact pins and the slots retain the connector on the primary circuit board. Often, the mechanical link between the header pins and the circuit board is insufficient to retain the connector onto the primary circuit board. Additional mechanical support between the connector and primary circuit board is provided by at least two flexible retention studs mounted onto the bottom of the frame. Each of the retention studs have inwardly tapered edges so that their distal ends are wider than their proximal ends. The studs mate with corresponding retention slots on the primary circuit board. As the studs are placed into the slots, they are compressed inwardly. Once through the slots, the distal ends of the studs expand pressing the circuit board in contact with the bottom of the connector.

DETAILED DESCRIPTION OF THE PREFERRED EMBODIMENTS

According to the invention, a stacked connector is provided for mounting multiple plug members and is described with reference to the Figures. As shown in FIGS. 1–4, the electrical connector 10 comprises a frame 12 and two interfaces 14 and 16.

Figure 1:
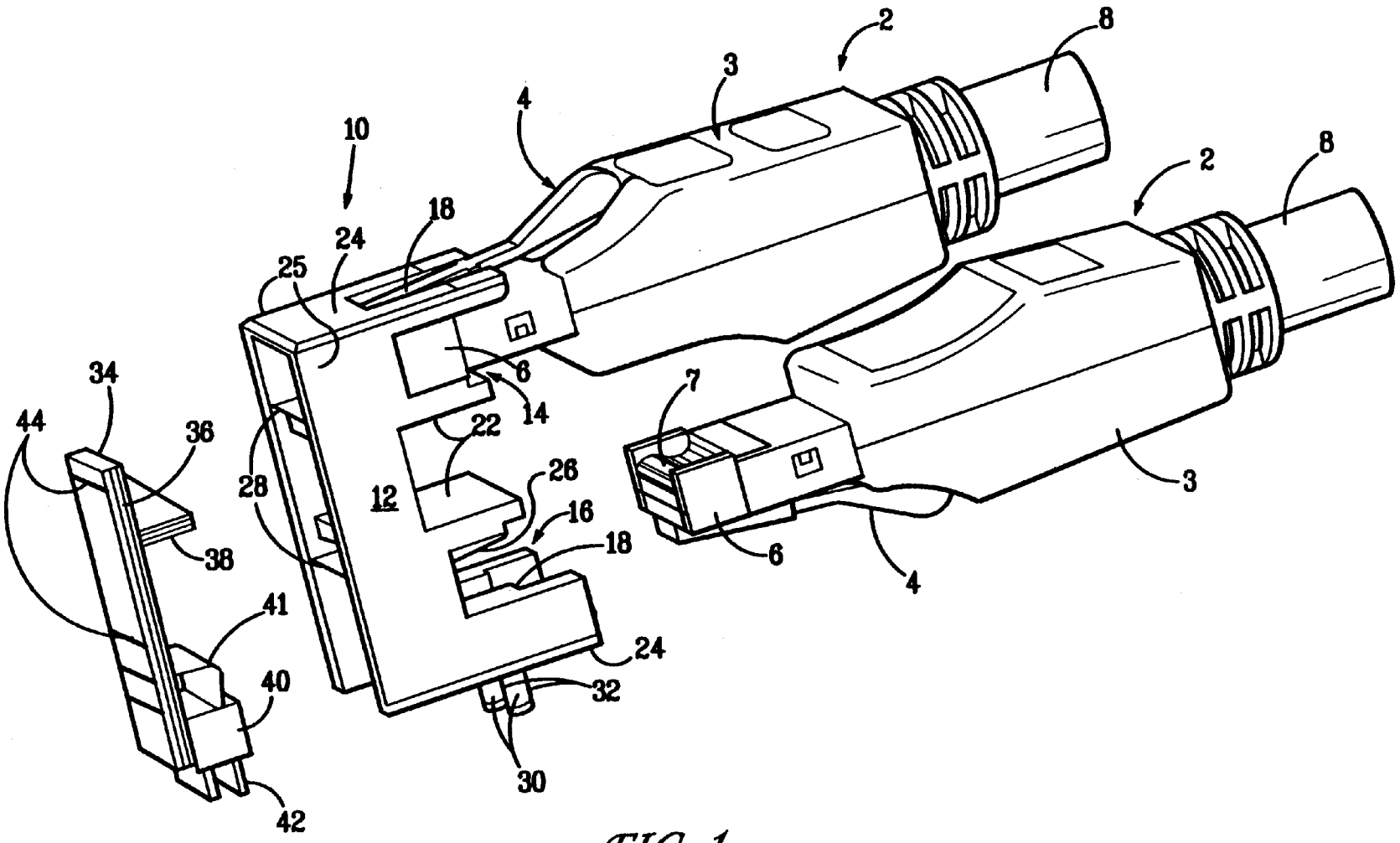
FIG. 1 is an exploded isometric view of the stacked connector of the invention.
Figure 2:
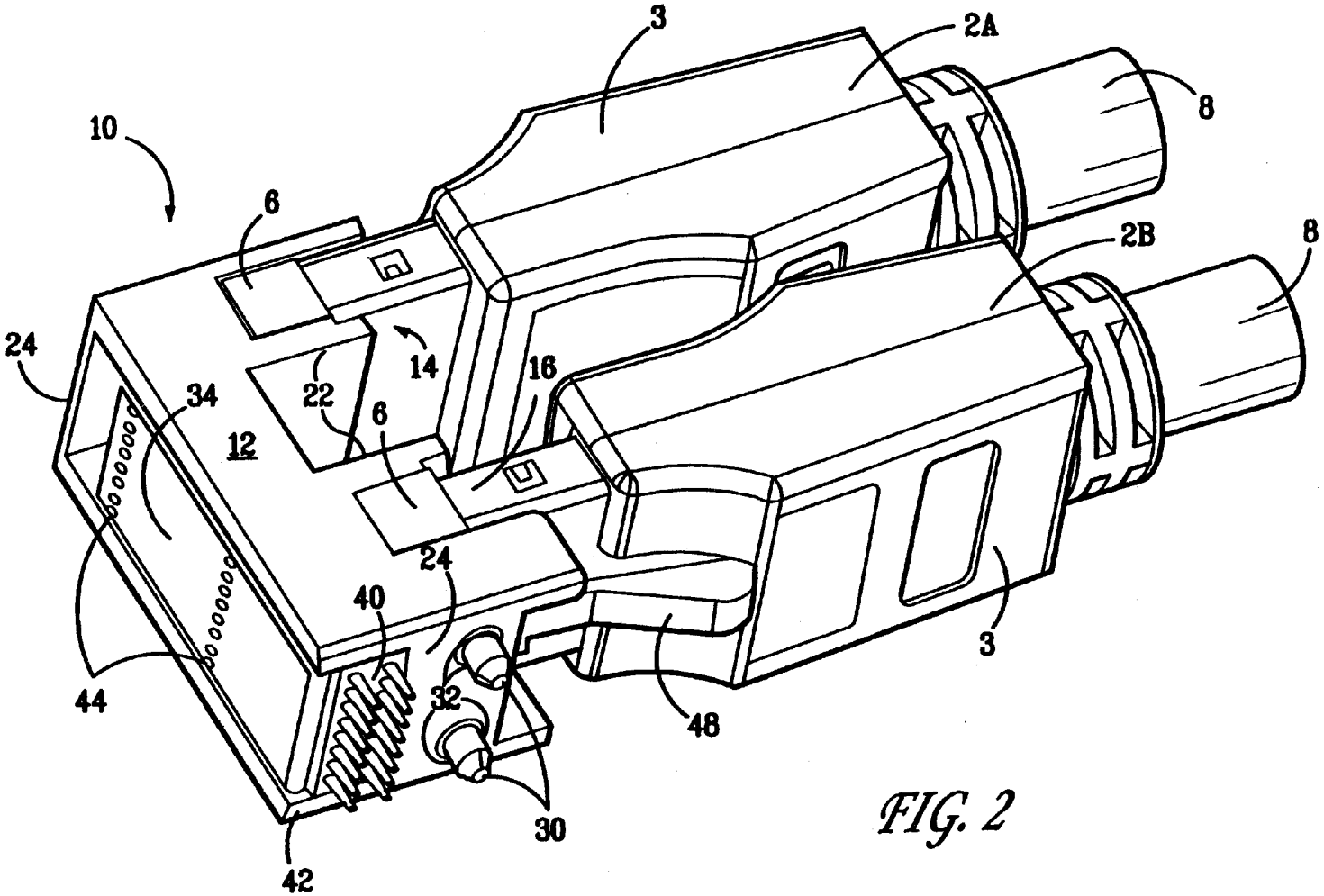
FIG. 2 is an isometric view of the stacked connector of the invention.
Figure 3:
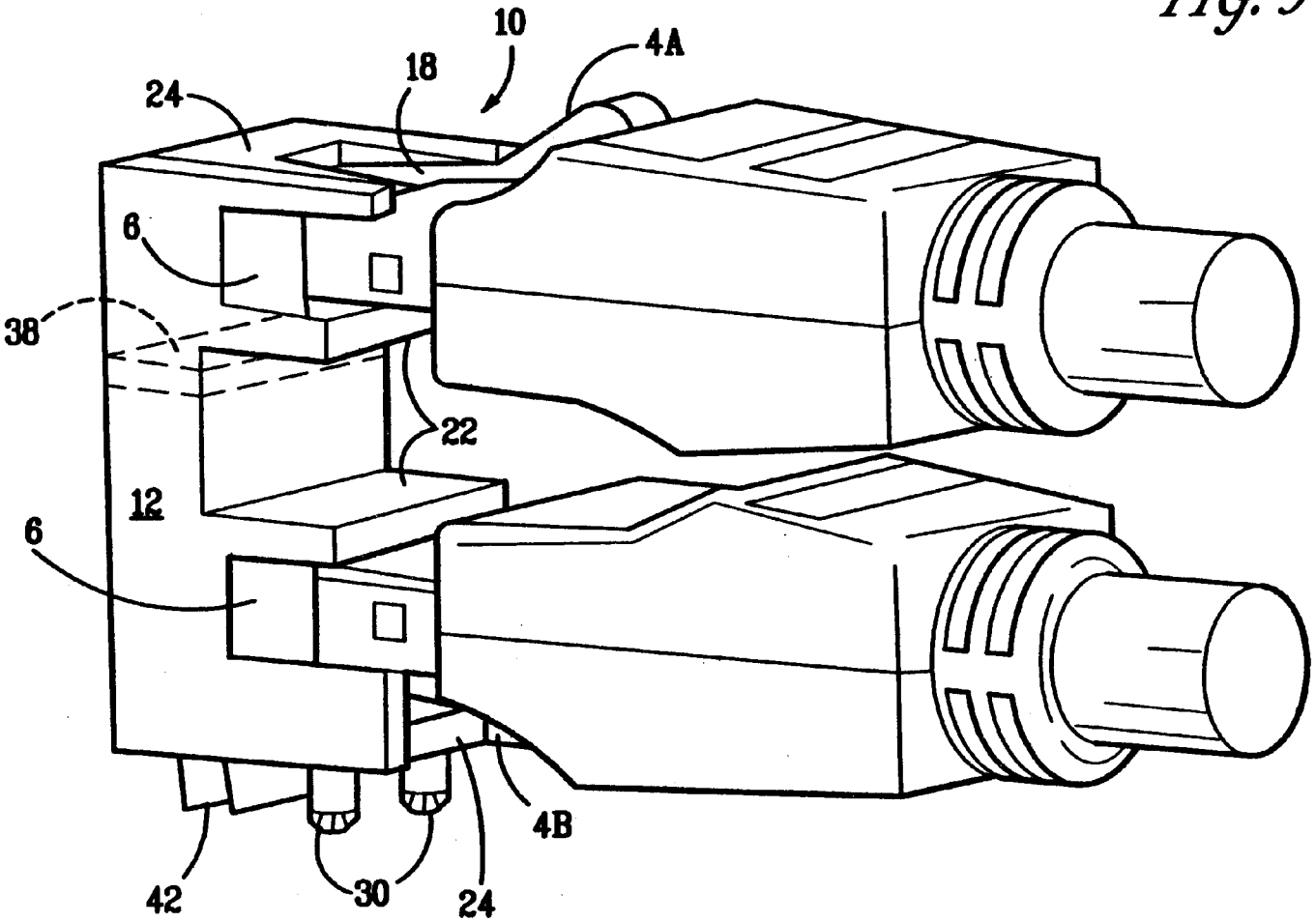
FIG. 3 is a front isometric view of the stacked connector of the invention.

As shown in FIGS. 1 and 2, the frame 12 comprises end walls 24 and side walls 25 which are connected together to form frame 12. The frame 12 is constructed from a conductive material such as stamped steel, aluminum or a semiconductive material appropriately doped to provide for conductivity. Frame 12 defines a first interface 14 and a second interface 16 for receiving and electrically coupling a plurality of plug members 2 to a primary circuit board 1. Alternatively, interfaces 14 and 16 are separate components which are mounted within the frame 12 by fasteners or by interference fit. In addition, multiple interfaces may be defined within frame 12, but for ease of description, the connector 10 is illustrated and described with two interfaces 14 and 16. Interfaces 14 and 16 include outer walls 24, side walls 25 and a set of inner walls 22. The interfaces 14 and 16 are spaced in substantially parallel and vertical juxtaposition to each other along the length of a frame 12.

The plug members 2 are retained within the interfaces 14 and 16 by an interference fit between the plug head 6 and the outer 24 and inner 22 walls of the interfaces. The interference fit is augmented by a latch 4, located on each plug member 2, which extends downwardly from the housing 3 to the plug head 6. The outer wall 24 of each interface 14 and 16 includes a latching notch 18. Latching notch 18 acts as a guide for latch 4 ensuring that the plug members 2 can be easily aligned within interfaces 14 and 16. As a plug member 2 is inserted into one of interfaces 14 and 16, the latch 4 engages the inside of the outer wall 24. The plug 2 is removed from the interface by pressing the top of the latch 4 downward, in a direction into the housing 3, which disengages the latch 4 from the inside of outer wall 24. In order to provide for easy removal, the plugs 2 are received within the interfaces 14 and 16 so that the latches 4 face outwardly and are easily accessible.

Figure 4:
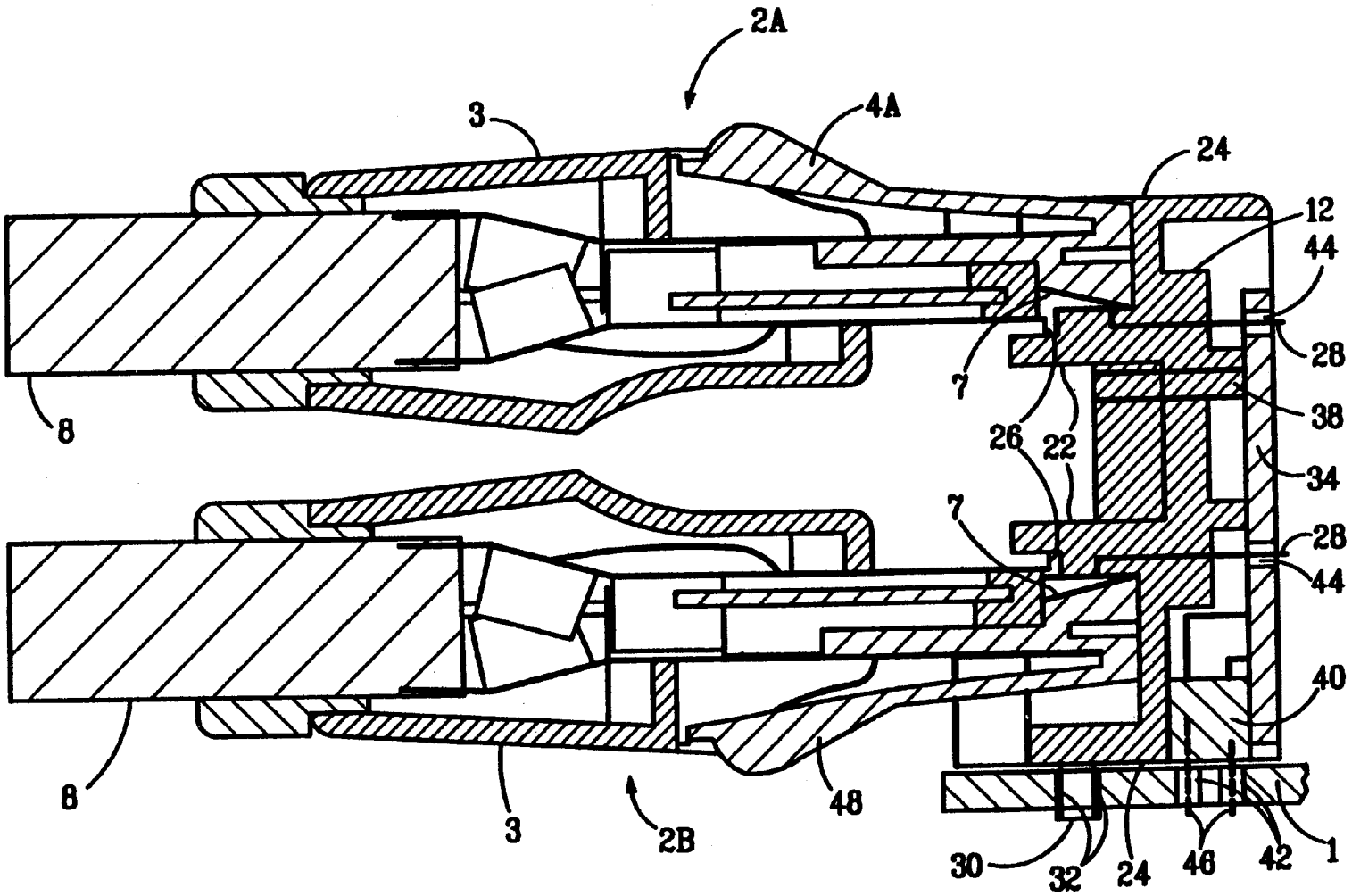
FIG. 4 is a side cut-away view of the stacked connector of the invention.
Figure 4A:
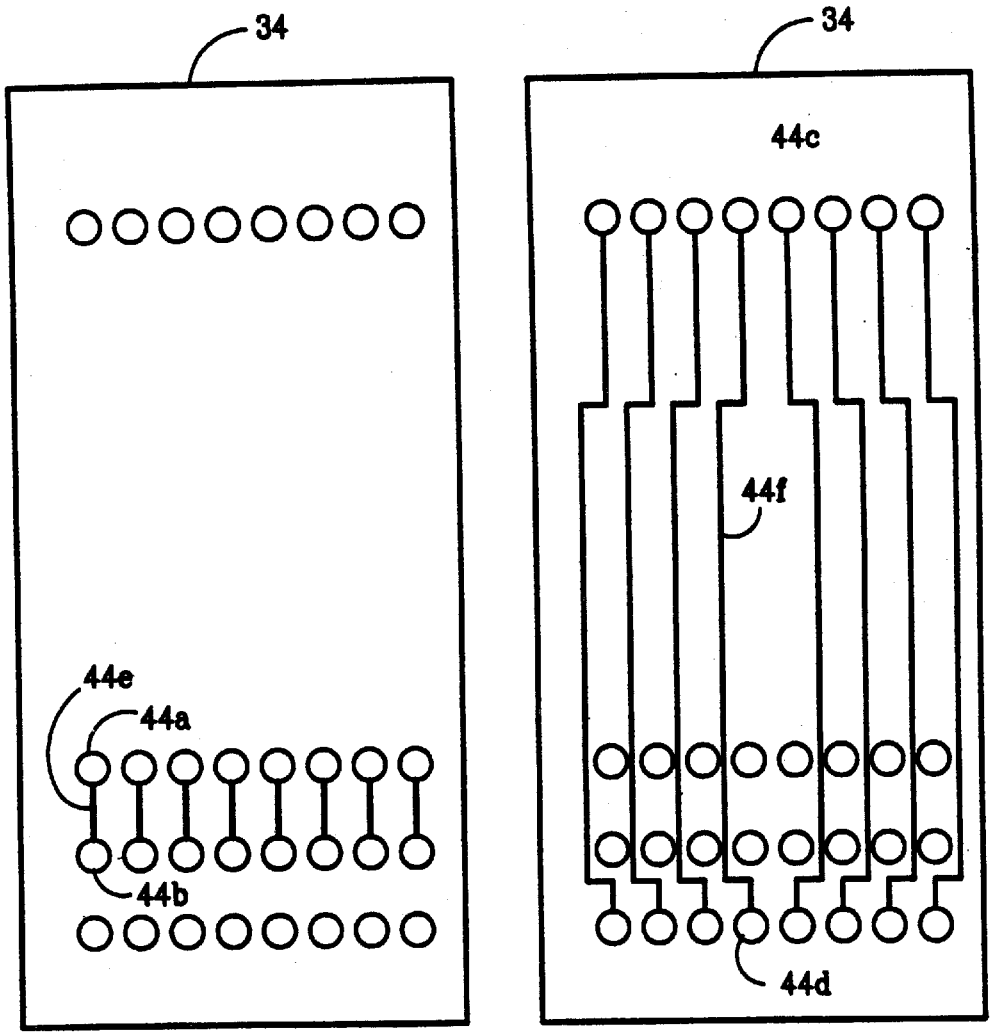
FIG. 4A is front and back view of the intermediate circuit board component of the invention.
Figure 5:
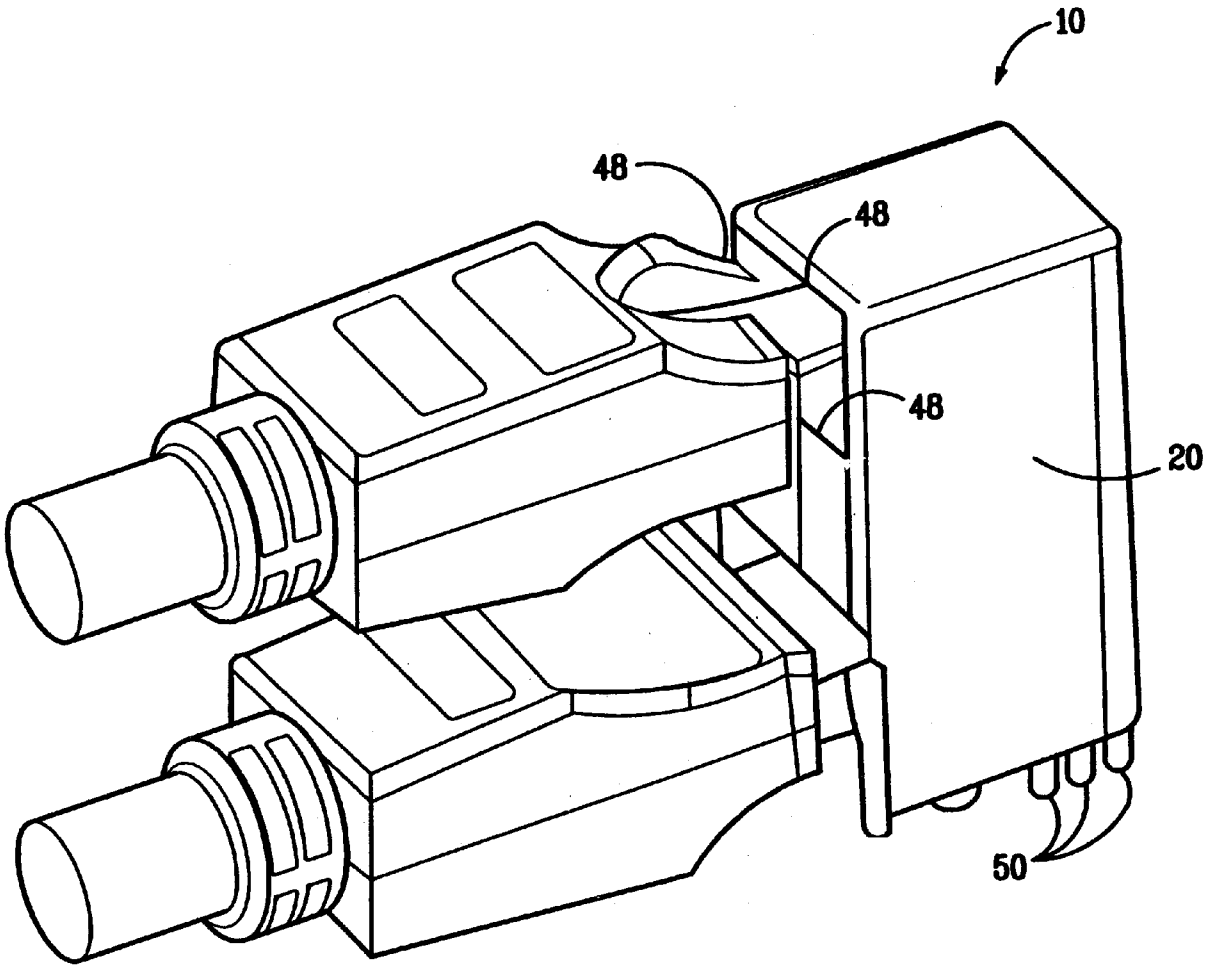
FIG. 5 is an isometric view of the stacked connector of the invention showing a casing placed around the outside of the frame of the connector.

Plug members 2 are electrically coupled to the primary circuit board 1 via interfaces 14 and 16. Each interface 14 and 16 is electrically coupled to the primary circuit board 1 by an intermediate circuit board 34. Intermediate circuit board 34 includes a ground plane 36 which may be internally or externally located. Ground plane 36 is grounded onto the primary circuit board 1 which itself is grounded, usually onto the outer box of the computer. The intermediate circuit board 34 is mounted on the frame 12 perpendicular to the interfaces 14 and 16. As shown in FIGS. 1 and 4, each interface 14 and 16 includes contacts which at one end define receptacle sections 26 and at the opposite end to define pin contacts 28. When plug members 2 are mated within interfaces 14 and 16, their contacts 7 are electrically linked to the receptacle sections 26. Further, receptacle sections 26 are electrically coupled to pin contacts 28 that cooperate with circuit board 34 electrically linking contacts 7 to intermediate circuit board 34. The pin contacts 28 are mated with contact slots 44 on the intermediate circuit board 34. As shown in FIG. 4A contact slots 44 of intermediate circuit board 34 may comprise a plurality of receiving apertures 44*a*, 44*b*, 44*c* and 44*d*. These receiving apertures are electrically coupled by contact slot leads 44*e* and 44*f*, such that, aperture 44*a* is electrically coupled to aperture 44*b* through contact slot lead 44*e* and aperture 44*c* is electrically coupled to aperture 44*d* through contact slot lead 44*f*.

The intermediate circuit board 34 is electrically coupled to the primary circuit board 1 by a right angle header 40. The right angle header 40 includes pin contacts 41, which mate with intermediate circuit board 34, and pin contacts 42, which mate with contact slots 4 on the primary circuit board 1. The mechanical link between the contact pins 42 and the slots retain the connector on the primary circuit board 1. In order to reduce the mechanical strain on the contact pins 42 and provide additional mechanical support between the connector 10 and primary circuit board 1, at least two retention studs 30 are located on the bottom of the frame 12. Retention studs 30 mate with retention slots 46 on primary circuit board 1.

Studs 30 are constructed from elastically deformable material. The studs 30 include a circumferential edge 32 which is inwardly tapered so that the distal ends of the studs 30 are wider than their proximal ends. In addition, the distal ends of the retention studs 30 are chamfered so as to allow for easy insertion of the studs 30 into the retention slots 46. As the studs 30 are placed into the slots 46 they elastically compress. Once the distal end of the studs pass through slots 46, they expand and abut the bottom of primary circuit board 1 pushing it upward. In particular, the tapered circumferential edges 32 of studs 30 act as a lever along which the edges of slots 46 slide so as to latch the circuit board 1 to connector 10.

Alternatively to employing intermediate circuit board 34, the pin contacts 28 are connected directly to the primary circuit board 1 by a flat wire or multiple independent wires as disclosed in U.S. Pat. No. 5,080,609, the disclosure of which is incorporated herein by reference. If a flat wire or multiple independent wires are employed, the wires which interconnect the two interfaces 14 and 16 and the circuit board 1 should be isolated and shielded from each other. This can be accomplished by mounting a conductive member internally of the frame 12 parallel to the intermediate circuit board 34. Preferably, the conductive member is L-shaped with one leg perpendicular to, and connected and grounded to, the intermediate circuit board 34. Apertures are provided in this leg to permit wires from interface 14 to extend through to the primary circuit board 1. The other leg extends parallel to the circuit board 34 between the two wire sets which interconnect the interfaces 14 and 16 to the circuit board 1 so as to isolate the wire sets from each other. In this embodiment a right angle header is preferably not be employed to link the wires to the circuit board. If this is the case, then the mounting studs 30 serve as the primary mechanical link between the circuit board and the connector.

The transportation of electric signals in any component results in electromagnetic emissions which cause the induction of stray current in a neighboring component. In order to prevent this, it is necessary to shield components from each other. Thus, plug members 2 include shielded housings 3 and are in turn attached to shielded wiring 8. Frame 12, being constructed from conductive material provides shielding which prevents the induction of stray currents. As shown in FIG. 4, the inner wall 22 of interface 14 faces the inner wall 22 of interface 16. Each inner wall 22 extends within the interfaces 14 and 16 beyond the plug ends 6. Thus, the inner walls 22 isolate the contacts 7 of plugs 2 from each other and act as a conductive barrier there between to prevent the formation of stray current.

As can also be seen in FIG. 4, the pin contacts 28 of each interface 14 and 16 (as shown in FIG. 1) extend laterally beyond inner walls 22. Thus, inner walls 22 fail to shield the pin contacts 28 of each interface. In order to provide additional shielding to the contacts 28, a shielding circuit board 38 is mounted to the intermediate circuit board 34 so as to extend within the frame 12 between and parallel to the interfaces 14 and 16. The shielding circuit board 38 generally comprises a semi-conductive material sandwiched between two conductive materials. The circuit board 38 is grounded to intermediate circuit board 34, which in turn is grounded to primary circuit board 1. As shown in phantom in FIG. 3, the shielding circuit board 38 extends along the entire width of the frame 12 so as to abut the sidewalls 25 of the frame 12 and completely isolate the pin contacts 28 from each other.

Figure 6:
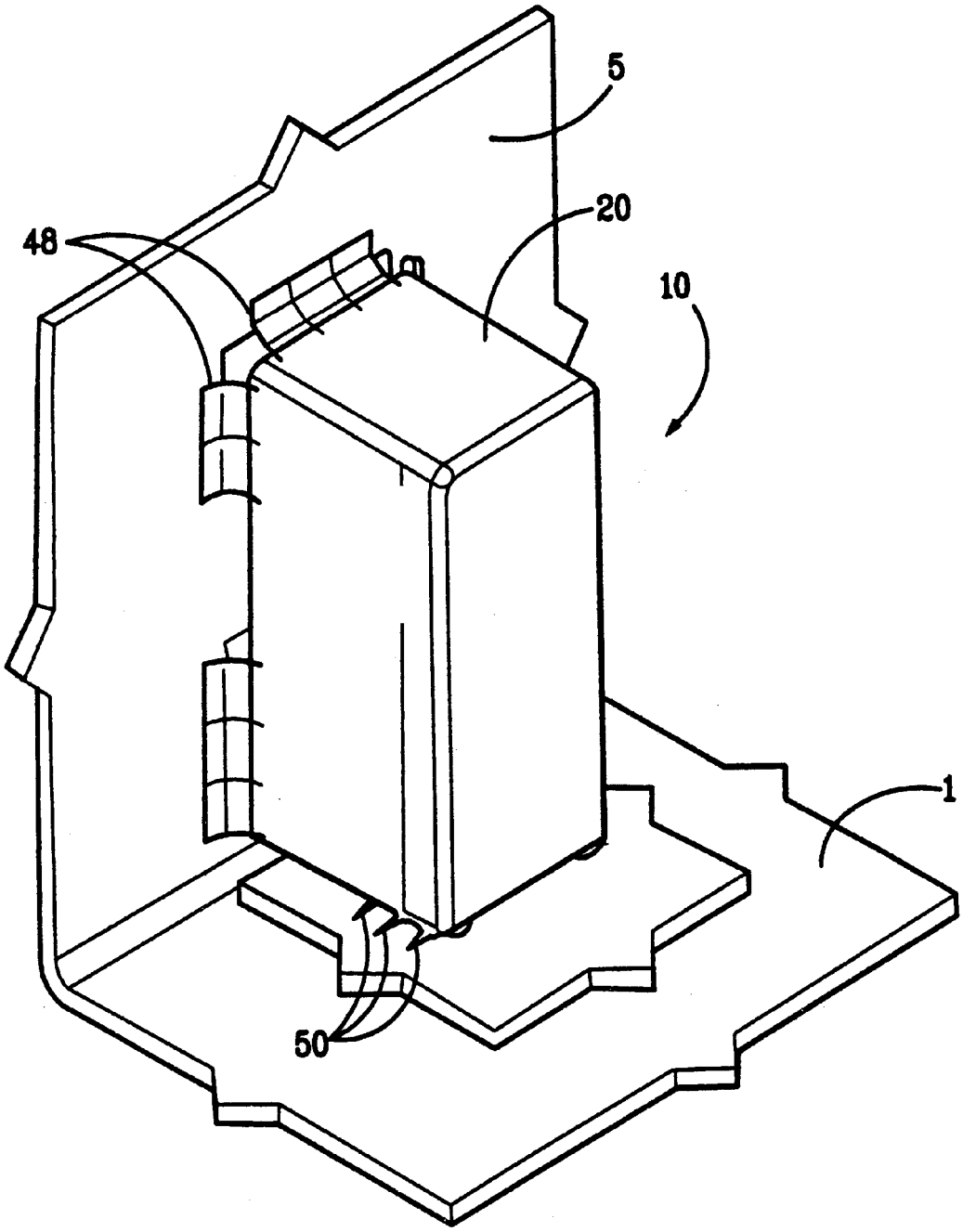
FIG. 6 is an isometric view showing the connector of the invention mounted to a primary circuit board within a computer.

As shown in FIG. 6, the connector 10 is mounted within a computer. In order to shield the entire connector 10 from neighboring components within the computer, a casing 20 encloses the entire frame 12. Flexible grounding fingers 48 are located along the peripheral edge of the casing 20. When mounted on primary circuit board 1, casing 20 abuts the outer shell 5 of the computer so that the fingers 48 contact and ground the casing 20 to outer shell 5. In some instances, casing 20 may not be in proximity to permit grounding fingers to contact shell 5. Grounding contacts 50, located at the bottom of the casing 20, provide additional grounding to the circuit board.

Although the present invention has been described above with respect to particular preferred embodiments, it will be apparent to those skilled in the art that numerous modifications and variations can be made to these designs without departing from the spirit or essential attributes of the present invention. Accordingly, reference should be made to the appended claims, rather than to the foregoing specification, as indicating the scope of the invention. The descriptions provided are for illustrative purposes and are not intended to limit the invention.

What is claimed is:

1. An electrical connector mounted onto a primary circuit board for providing a stacked interface for multiple plug members said connector comprising:

stacked first and a second interfaces spaced in substantially parallel juxtaposition to each other along the length of a frame;

an intermediate circuit board mounted on the frame transverse to the interfaces, wherein said interfaces are electrically coupled to the intermediate circuit board and said intermediate circuit board is adapted to be electrically coupled to the primary circuit board; and a shielding circuit board mounted to the intermediate circuit board so as to extend within the frame between the interfaces, said shielding circuit board extending along the entire width of the frame.

2. The electrical connector of claim 1, further comprising a latching surface for engaging a latch of a plug member as it is mounted within an interface.

3. The electrical connector of claim 1, wherein the first and second interfaces each include a set of electrical contacts wherein a first end of the set of contacts define a receptacle section and a second end of the set of contacts defines pin contacts, said plug members having a contact head which mates with the receptacle sections, wherein the pin contacts mate with the intermediate circuit board whereby the plug members are electrically coupled to the primary circuit board.

4. The electrical connector of claim 1, wherein the intermediate circuit board includes a ground plane which is connected to the ground plane of the primary circuit board.

5. The electrical connector of claim 1, further comprising a right angle holder for electrically coupling the intermediate circuit board to the primary circuit board.

6. The electrical connector of claim 1, further comprising at least two flexible studs having an inwardly tapered edge.

7. The electrical connector of claim 6, wherein the latching surface is located on an interface so that when a plug element is placed within the first and second interface, the latches of each plug face opposite directions.

8. The electrical connector of claim 7, wherein the interfaces further comprise an inner and an outer wall said latching surface being located on an inside surface of the outer wall, said inner wall isolating the ends of the plug members from each other.

9. The electrical connector of claim 1, further comprising an electrically conductive casing which encloses the frame.

10. The electrical connector of claim 9, wherein the casing includes grounding fingers spaced about the periphery of the casing so that when the electrical connector is mounted on the primary circuit board of a computer, the grounding fingers contact an outer shell of the computer and ground the casing thereto.

11. An electrical connector mounted onto a primary circuit board for providing a stacked interface for multiple plug members, said connector comprising:

at least two stacked interfaces spaced in substantially parallel juxtaposition to each other along the length of a frame;

conductive elements for electrically coupling the interfaces to a primary circuit board;

an intermediate circuit board positioned between said stacked interfaces and said primary board mechanically receiving said stacked interfaces;

at least one shielding member extending parallel to said multiple plug members within the frame so as to isolate the at least two interfaces from each other;

a connector for electrically coupling the intermediate circuit board to the primary circuit board; and at least two flexible studs having inwardly tapered edges, said flexible studs mechanically coupled to said connector and to said primary circuit board.

12. The electrical connector of claim 11, wherein the at least two interfaces include a set of electrical contacts wherein a first end of the set of electrical contacts define a receptacle section and a second end defines pin contacts.

13. The electrical connector of claim 11, further comprising an electrically conductive casing which encloses the frame.

14. The electrical connector of claim 11, wherein the casing includes grounding fingers spaced about the periphery of the casing so that when the electrical connector is mounted on the primary circuit board of a computer, the grounding fingers contact an outer shell of the computer and ground the casing thereto.

15. The electrical connector of claim 11 wherein the connector for coupling the interfaces to the circuit board comprises an intermediate circuit board mounted on the frame perpendicular to the interfaces.

16. The electrical connector of claim 15, wherein the at least one shielding member is mounted on the intermediate circuit board between and parallel to the interfaces, said at least one shielding member extending along the entire width of the frame so as to abut the walls of the frame.

17. The electrical connector of claim 11, wherein the connector the at least two interfaces to the circuit board comprises a first and second set of wires.

18. The electrical connector of claim 17, the shielding member comprising:

a lateral conductive leg having a set of apertures, the lateral conductive leg being connected to a grounded back member of the frame so as to extend in a direction substantially parallel to the interfaces; and a longitudinal conductive leg mounted onto the lateral conductive leg and extending in a direction substantially perpendicular to the interfaces;

wherein the first set of wires extend from one of the at least two interfaces, through the set of apertures, along a first side of the longitudinal conductive leg to the primary circuit board; and wherein the second set of wires extend from another of the at least two interfaces, along a second side of the longitudinal conductive leg, to the circuit board;

whereby the longitudinal conductive leg isolates and separates each of the first and second set of wires from each other.

19. The electrical connector of claim 11, wherein the at least two interfaces further comprise a latching surface for engaging a latch of a plug member which is mounted within the interfaces.

20. The electrical connector of claim 19, wherein the latching surface is located on the outside of an interface so that when a plug element is placed within a first and a second interface, the latches of each plug face opposite directions.

21. The electrical connector of claim 20, wherein the at least two interfaces further comprise an inner and an outer wall said latching surface being located on the inside of the outer wall, said inner wall isolating the ends of the plug members from each other.

* * * * *

UNITED STATES PATENT AND TRADEMARK OFFICE

CERTIFICATE OF CORRECTION

PATENT NO. : 6,375,496 B1
DATED : April 23, 2002
INVENTOR(S) : Daniel T. Casey et al.

It is certified that error appears in the above-identified patent and that said Letters Patent is hereby corrected as shown below:

Title page,

Item [56], References Cited, the following references should appear:

| | | |
|---|---|---|
| -- 5,672,078 | 9/1997 | Fukamachi et al. |
| 5,759,067 | 6/1998 | Scheer |
| 5,865,646 | 2/1999 | Ortega et al. -- |

Signed and Sealed this

Fifth Day of November, 2002

*Attest:*

*Attesting Officer*

JAMES E. ROGAN
*Director of the United States Patent and Trademark Office*